US005820174A

United States Patent [19]

Parikh et al.

[11] Patent Number: 5,820,174

[45] Date of Patent: Oct. 13, 1998

[54] LOCKABLE SLAMMABLE PADDLE LATCH

[75] Inventors: Bhupendra Parikh, Parma; Donald J. McFarland, Strongsville, both of Ohio

[73] Assignee: Cleveland Hardware & Forging Company, Cleveland, Ohio

[21] Appl. No.: 843,539

[22] Filed: Apr. 18, 1997

[51] Int. Cl.[6] ..... E05C 19/10

[52] U.S. Cl. ..... 292/126; 292/216; 292/DIG. 31; 70/208

[58] Field of Search ..... 292/126, 216, 292/DIG. 31, 124, 224; 70/208, 210, 472

[56] References Cited

U.S. PATENT DOCUMENTS

| | | | |
|---|---|---|---|
| 2,642,300 | 6/1953 | Pelcin . | |
| 3,338,610 | 8/1967 | Pelcin et al. | 292/126 |
| 4,320,642 | 3/1982 | Pastva, Jr. | 292/226 |
| 4,438,964 | 3/1984 | Peters . | |
| 4,703,961 | 11/1987 | Weinerman et al. . | |
| 4,892,338 | 1/1990 | Weinerman et al. | 292/166 |
| 4,911,487 | 3/1990 | Rachocki | 292/216 |
| 4,951,486 | 8/1990 | Braun et al. . | |
| 5,042,853 | 8/1991 | Gleason et al. | 292/126 |
| 5,046,340 | 9/1991 | Weinerman et al. . | |
| 5,058,937 | 10/1991 | Miehe et al. | 292/165 |
| 5,127,686 | 7/1992 | Gleason et al. | 292/216 |
| 5,299,844 | 4/1994 | Gleason | 292/240 |
| 5,360,244 | 11/1994 | Gleason et al. . | |
| 5,409,272 | 4/1995 | McCormack . | |

*Primary Examiner*—Steven N. Meyers
*Assistant Examiner*—Tuyet-Phuong Pham
*Attorney, Agent, or Firm*—Calfee, Halter & Griswold LLP

[57] ABSTRACT

A lockable, slammable paddle operated latch assembly for use as a latching and locking mechanism on a door or panel of an enclosure or compartment has a paddle handle pivotally mounted on a pin transversely mounted through side walls of a recessed draw of a mounting pan and attached at one end to an orthogonal trip/lock member on the interior of the pan adjacent the draw. One extension of the trip/lock member is positioned underneath the locking arm of a key cylinder when the paddle is fully recessed and the key is in the locked position. Another extension of the trip/lock member contacts the latch which is pivotally mounted on the interior of the pan draw. A torsion spring about the latch mounting shank biases the latch into the latched position, but allows the latch to be deflected for engagement with a striker with the trip/lock member locked or unlocked, so that the latch can be slammed shut even when locked. A latch guide can also be mounted on the latch mounting shank.

28 Claims, 4 Drawing Sheets

LOCKABLE SLAMMABLE PADDLE LATCH

FIELD OF THE INVENTION

The present invention pertains generally to latches for secured closure of access panels or doors to compartments, and more particularly to latches with locking mechanisms.

BACKGROUND OF THE INVENTION

Many types of latches have been devised for performing secured closure of access panels or doors to compartments such as cabinets and storage bins. See, for example, U.S. Pat. Nos. 5,042,853 and 4,911,487. Paddle-type latches have a generally planar operation handle typically mounted within a pan or escutcheon to pivot upward to actuate the latch mechanism attached to the back side of the pan. In most such latches, the handle is connected to the latch mechanism by a linkage which passes through a major flat portion or bottom of the pan. This opening provides a passage for water or contaminants to invade the latch mechanism and the enclosure.

Another disadvantage associated with these types of latches is the inability to be closed or slammed shut when in the locked position because there is, in general, a fixed or permanent linkage between the paddle handle and latch, or the relative complexity of mechanisms which do allow closure in the locked position.

For example, some latch mechanisms having a fixed linkage between the operating handle and the latch, not only require some sort of actuator linkage to pass through the pan, but also kick the handle up when the latch is slammed shut. Also, many latch assemblies of the prior art lack a latch guide which guides a striker into secured engagement with the latch.

SUMMARY OF THE INVENTION

The present invention overcomes these and other disadvantages of the prior art by providing in one aspect a paddle operated latch assembly having a pan with a peripheral mounting flange and draw with a continuous unperforated major expanse, a paddle handle mounted within the draw over the major expanse upon a paddle pin which traverses the draw and intersects opposing walls of the draw, a trip/lock member pivotally connected to the pin on an interior side of the pan, the trip/lock member having a trip arm which extends beyond the draw on the interior side of the pan, a latch rotationally mounted on a shank which extends from the interior side of the pan draw, about which the latch rotates in a plane substantially parallel to the major expanse of the draw, a portion of the latch contacting the trip/lock member when the latch is in the latched position, and a spring which biases the latch into the latched position.

In accordance with another aspect of the invention, the paddle operated latch assembly as explained above further including a lock cylinder mounted in the pan, operative to rotate a locking cam on the interior side of the pan over the locking arm of the trip/lock member when the latch is in the latched position.

In accordance with another aspect of the invention, a paddle latch assembly providing a mounting pan having a peripheral flange, a recessed draw and an exterior surface and an interior surface; the recessed draw having side walls, side wall holes, and a continuous unperforated major expanse; a paddle handle having a recessed position and an actuated position; the paddle handle pivotally mounted upon a paddle pin within the recessed draw on the exterior surface; the paddle pin traversing the draw on the exterior side and extending through the side wall holes; a latch having a hooked end for securing a striker into a striker receiving cavity; means for rotatably mounting the latch upon the recessed draw on the interior side of the mounting pan; the latch having a latched position and a release position; and cooperating means connected to the paddle handle and positioned for contact with the latch upon rotation of the paddle handle to move the latch from a latched position to a release position.

In accordance with another aspect of the invention, a paddle latch mounting pan providing for recessed mounting of paddle handles and mounting of a latch assembly, where the pan has an exterior side and an interior side; the peripheral flange is adapted to be flush mounted to a door; the recessed draw has a major unperforated expanse and side walls with holes for pivotally mounting a paddle pin on the exterior side; and a latch assembly is mounted upon the interior side of the expanse without penetrating the expanse. Although the mounting pan is shown in the drawings with a particular latch assembly, the mounting pan could be utilized with different latch devices that do not penetrate the expanse.

To the accomplishment of the foregoing and related ends, the invention then comprises the features hereinafter fully described and particularly pointed out in the following detailed description made with reference to the annexed drawings which set forth in detail certain illustrative embodiments of the invention, these being indicative however, of but some of the various ways in which the invention may be employed.

DETAILED DESCRIPTION OF PREFERRED EMBODIMENTS

Figure 1:
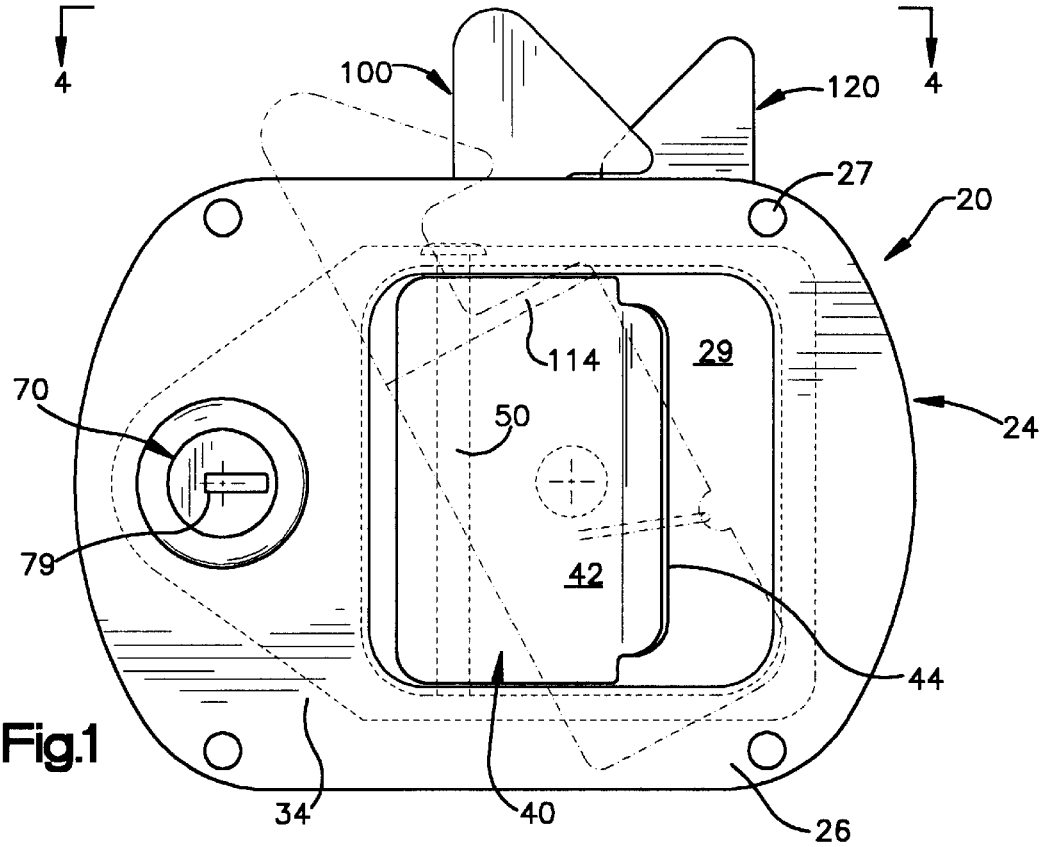
FIG. 1 is a plan view of the latch assembly of the present invention.

With reference to FIGS. 1–5, there is illustrated a paddle operated lockable latch assembly indicated generally at 20 which includes a mounting pan 24 of a generally rectangular shape, having a peripheral flange 26 adapted to be flush mounted to a door (for example by fasteners through fastener holes 27 ) with a recessed draw 28 with side walls 30–32 which protrude through or sit in a latch opening in a door. The recessed draw 28 has a continuous unperforated major expanse 29 defined as the substantially planar area between the side walls 30–32. The fact that there are no holes in the unperforated major expanse 29 greatly enhances the resistance of the latch assembly to invasion of foreign objects (such as a pry bar) and corrosives such as water and salt. The dotted line in FIG. 1 indicates the periphery 34 of an exemplary cutout in a door in which the latch may be installed.

A paddle or latch handle 40 of a generally rectangular shape is pivotally mounted on a paddle pin 50 within the interior of the recessed draw on the exterior side of the mounting pan 24. The paddle handle has a front face 42 with a graspable flange 44, and a pair of spaced side walls 46 with holes 48 for engaging the paddle pin 50. To prevent over-rotation of the paddle handle within the recessed draw 28, the side walls 46 of the paddle handle contact the protruding dimples 49 located on the exterior surface of the draw.

Figure 4:
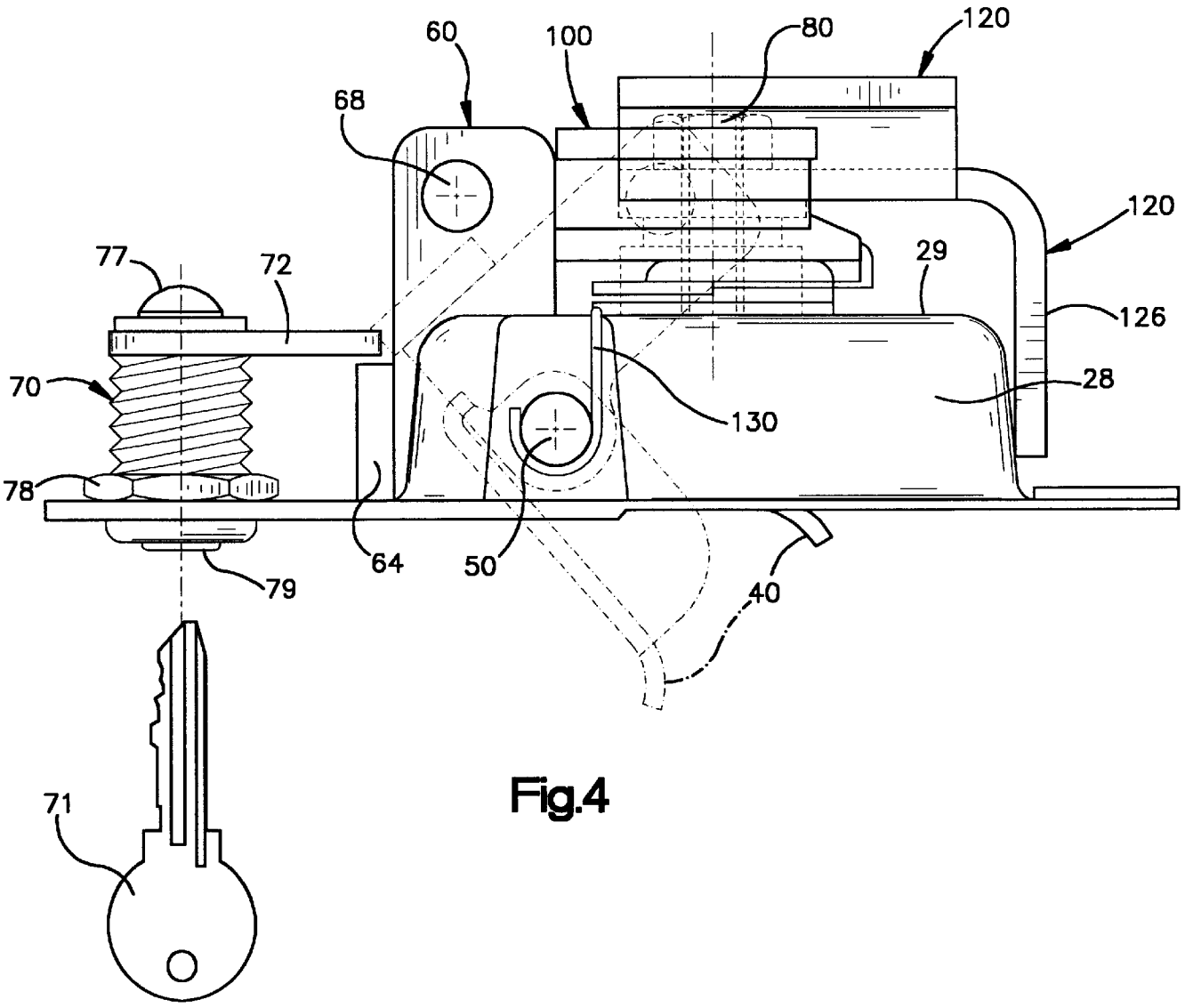
FIG. 4 is a side view of the latch assembly of the present invention taken in the direction of arrows 4—4 in FIG. 1, and FIGS. 5A and 5B are plan and side views, respectively, of a linked dual paddle latch assembly of the present invention.

The paddle pin 50 allows movement of the paddle handle 40 to pivot between a fully recessed position within the draw shown in solid lines in FIG. 4, and an open release position shown in FIG. 4 in phantom. A distal end of the paddle pin is provided with flats 54 which fit within flat-sided holes 48 in the paddle handle walls whereby rotation of the paddle handle rotates the pin. The paddle pin 50 is transversely mounted through opposed side walls 30, 32 of the mounting pan 24 in pin holes 36. A distal end of the paddle pin 50 on the interior side of the pan is positively connected to a trip/lock member 60 through a square hole 66 at the base of a trip arm 62 of the trip/lock member on the interior side of the mounting pan 24 adjacent the side wall of the draw 28. Thus, rotation of the paddle handle 40 rotates the paddle pin 50 which rotates the trip/lock member 60 which, as described further below, disengages the latch. The trip arm 62 is generally planar and perpendicular to the longitudinal axis of the paddle pin 50 and oriented parallel to and closely flanking lower side wall 32, and extends beyond the continuous unperforated major expanse 29 of the recessed draw 28.

The trip/lock member 60 also has a locking arm 64 which extends perpendicularly from the trip arm 62, generally parallel to and closely adjacent and flanking side wall 31, also adjacent an opening 74 in the pan peripheral flange for a lock cylinder. The locking arm 64 also functions to prevent over-rotation of the latch beyond the open release position by the latch contacting the locking arm 64.

A key operated lock cylinder 70 is mounted in a hole 74 in an expanded portion 76 of the mounting pan 24 secured by a lock cylinder nut 78 with a key hole 79 exposed upon the exterior face of the mounting pan to allow for insertion of a key 71 to operate the lock cylinder 70. As shown in FIG. 4, a locking cam 72 is attached to the rotating end 77 of the lock cylinder 70 opposite the key hole 79 and positioned for engagement with the locking arm 64 of the trip/lock member 60.

Figure 2:
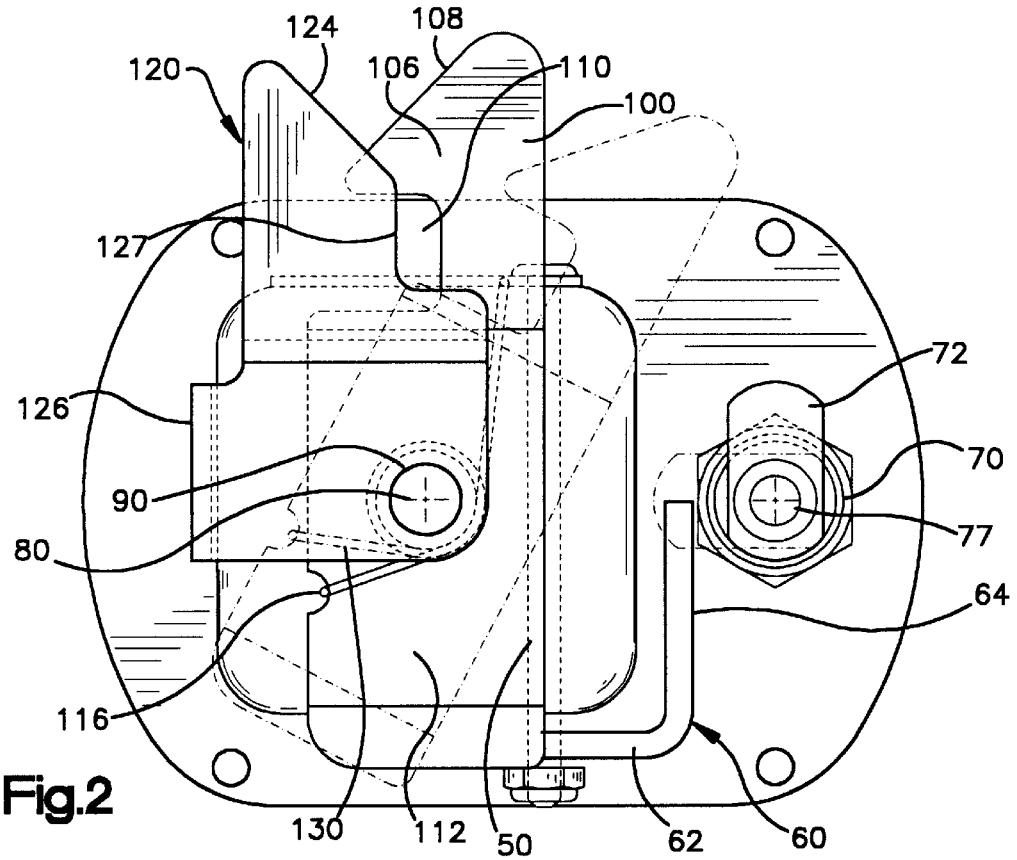
FIG. 2 is a rear view of the latch assembly of the present invention of FIG. 1.

With the paddle in the fully recessed position as shown in FIG. 2, the locking arm 64 of the trip/lock member is positioned within the depth profile of side wall 31 of the pan draw (i.e., the locking arm 64 does not extend above or beyond the continuous unperforated major expanse 29 of the pan draw 28). In this position, in a locking embodiment of the latch assembly of the invention, a locking cam 72 (shown in phantom), attached to the distal interior end of a lock cylinder assembly 70 mounted in hole 74 in the peripheral flange of the pan, is positionable over the locking arm 64 of the trip/lock member 60 when the lock cylinder is turned to a locked position by key 71. As further described below, the trip arm 62 of the trip/lock member 60 contacts a base area of a latch 100 which is pivotally mounted on the interior of the pan draw 28.

Figure 3:
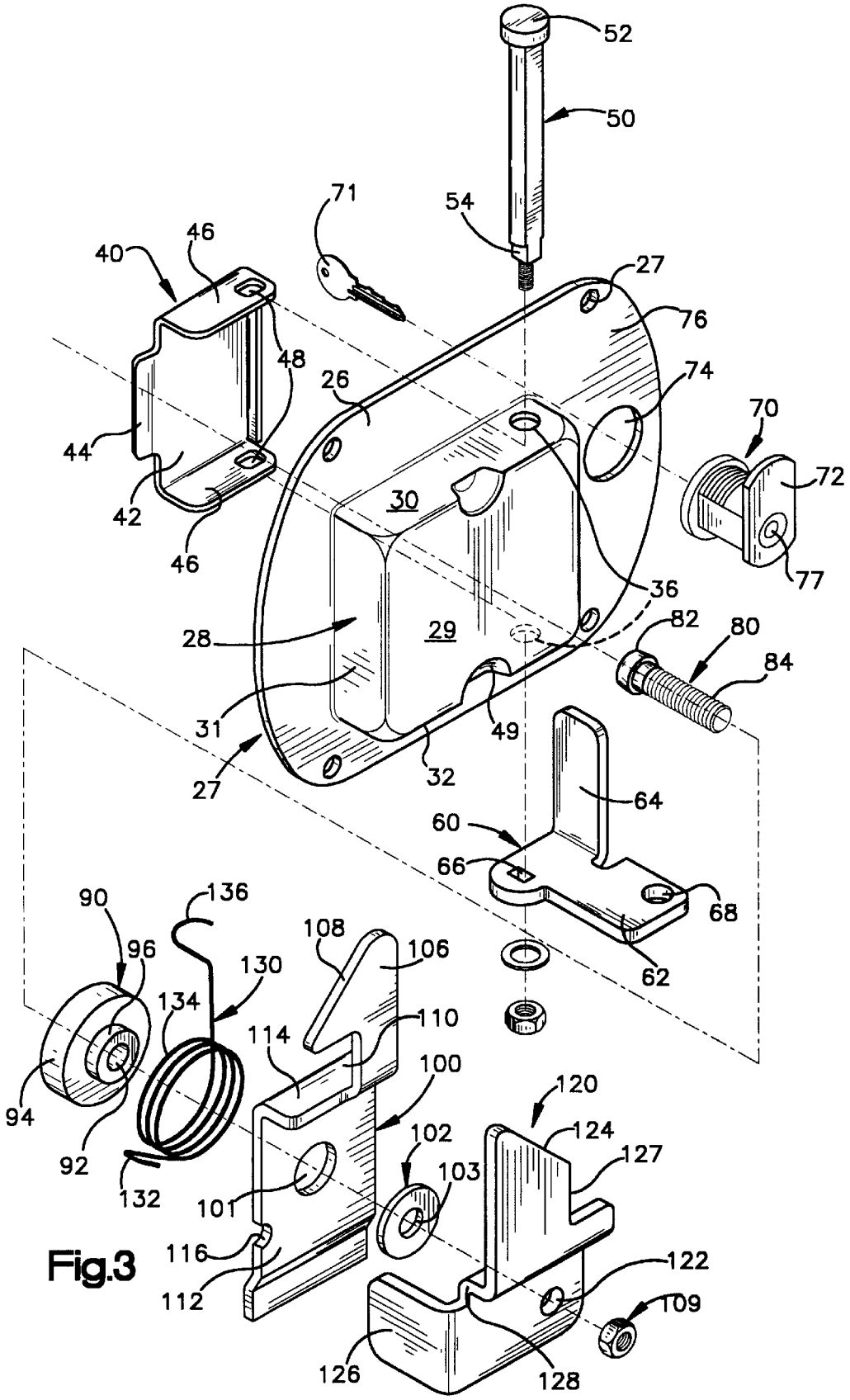
FIG. 3 is an exploded perspective view of the paddle latch of the present invention.

With reference to FIG. 3, it is shown that the head 82 of a shank 80 for mounting the latch 100 is attached to the center of the interior side (such as by weld) of the continuous unperforated major expanse 29 of the recessed draw 28 of the mounting pan 24 form a permanent attachment of the shank to the interior side of the expanse which does not perforate or require any kind of aperture or opening in the expanse is suitable for achieving this aspect of the invention. Threads 84 are formed on the shank. A shoulder spacer 90 is placed over the shank and a torsion spring 130 disposed about the spacer. As further shown in FIG. 3, the shoulder spacer 90 includes an inner hole 92 of constant diameter for receiving the shank 80, and a outer radial side wall 94 for receiving the torsion spring 120, and a shoulder 96 which fits through a hole 101 in a latch 100.

The latch 100 is pivotally connected and secured to the interior side of the recessed draw 28 by means of the threaded shank 84, shoulder spacer 90, spacer washer 102 and lock nut 104. The threaded section of the shank 84 passes through a shoulder spacer hole 92, the latch hole 101, a spacer washer hole 103, and the lock nut 104 such that the latch 100 is rotationally secured to the recessed draw 28 of the mounting pan 24, to rotate in a plane parallel to the continuous unperforated major expanse 29.

The latch 100 has a hooked end 106 with a slanted incline surface 108 thereby forming a striker receiving cavity 110 for engaging the striker (not shown), a lower leg 112 which the trip arm 62 of the trip/lock member 60 contacts upon rotation, and a latch shoulder 114 formed therebetween the lower leg 112 and the hooked end 106. The latch 100 has a center hole 101 in the lower leg 112 for receiving the shoulder 96 of a shoulder spacer 90 such that the latch 100 is pivotally mounted upon the shank 80.

A torsion spring 130 having a first end 132 received in a notch 116 in the latch lower leg 112 has a wound torsion spring body 134 which is wrapped around the outer radial side wall 94 of the shoulder spacer 90, and a second end 136 attached to the paddle pin head 52. The torsion spring 130 biases the latch 100 into the vertical latched position (shown in solid lines in FIG. 1). The contact of the latch lower leg 112 with the trip arm 62 of the trip/lock member 60 chocks the latch 100 in the vertical latched position against the torsional moment force of spring 130 moment. Thus the latch maintains a vertical latched position.

The torsion spring 130 allows the latch 100 to be deflected for engagement with a striker when the locking cam 72 of the lock cylinder 70 is in either the locked or unlocked position so that the latch can be slammed shut over a striker even when locked. FIG. 2 shows the latch in the released position in phantom and the locking cam 72 in the locked position (in phantom) and in the unlocked position.

An optional latch guide 120 can also be mounted on the latch shank 80 over the latch 100. The purpose of the latch guide is to more precisely guide a striker, such as a common bar-type striker having a rod section oriented transverse to the hooked end 106 of the latch, into the striker receiving cavity 110. The latch guide 120 comprises a hole 122 for receiving the shank, a tapered vertical end 124 for guiding the striker into the striker receiving cavity 110 which is confined by a edge 127 whereby the guide encloses the striker receiving cavity 110 in conjunction with the latch hook when the latch 100 is in the latched position. The latch guide thereby also acts as a keeper which prevents the striker from moving laterally out from under the hooked end 106 of the latch, or vice versa, as may occur, for example, if an enclosure lid to which the striker is mounted is struck laterally. The latch guide 120 also comprises a latch guide indexing arm 126 which is oriented substantially parallel to and flush against the vertical side wall 31 of the mounting pan 24. The latch guide 120 also comprises a shoulder 128 formed between the tapered vertical end 124 and the latch guide indexing arm 126 to increase the dimensional depth of the latch assembly.

The operation of the latch assembly can now be described. The paddle pin 50 allows pivotal movement of the paddle handle 40 within the pan draw 38 between a closed/recessed position as shown in bold lines in FIG. 4 and a release/open position as shown in phantom. In operation, as shown in FIG. 2 (in a locking embodiment of the latch assembly) in an unlocked position (shown in bold lines) such that the locking cam 72 is not overlying the trip arm 64, as the paddle handle 40 is rotated so is the paddle pin 50, which rotates the trip member 60. As the trip member 60 is rotated, the trip arm 62 of the trip/lock member 60 contacts the latch lower leg 112, thereby rotating the latch 100 about shank 80 towards the lock assembly such that the striker is released from the displaced striker receiving cavity 110. Thus actuation of the paddle handle 40 results in rotation of the latch 100 from a latched position to a released position to thereby disengage the hooked end 106 of the latch from the striker. The door/closure is thereby unsecured and may be opened.

It is important to note that in disengaging the striker a rotational force is applied by the torsion spring 130 to the latch lower leg 112. Thus as the latch is rotated out of engagement with the striker, the spring is wound and acts to apply a restoring moment to the latch. Once the paddle handle is released to its closed/recessed position, the spring rotates the latch towards the latch guide 120 until the lower leg 112 of the latch contacts the trip arm 62 of the trip/lock member thereby maintaining the latch in the vertical latched position.

The locking cam 72 of the lock cylinder mechanism may be rotated by actuation of an external key 71 between a locked position shown in phantom in FIG. 2, wherein the locking cam 72 overlies the locking arm 64 of the trip/lock member and thereby blocks rotation of the trip member against the latch lower leg 112. When one attempts to actuate the paddle handle 40 with the locking cam 72 in its locked position, the locking cam blocks upward rotational movement of the locking arm 64 of the trip/lock member thereby arresting rotation of the trip member with the paddle pin. In order to disengage the hooked end of the latch from the striker, it is necessary to rotate the locking cam out of its locked position to thereby allow the paddle handle to rotate and effectuate rotation of the latch.

Because the latch element is normally biased towards its latched position, it is possible to close and latch an opened closure/door without using the paddle handle. As the closure/door is moved downward, the striker is forced against the slanted incline of the hooked end of the latch. As the striker is moved downward into contact with the slanted incline, the latch is forcibly rotated away from the latch guide and the torsion spring is wound. Once the striker enters the striker receiving cavity, the hooked end of the latch is rapidly rotated towards the latch guide and into engagement with the striker under the restoring force applied by the torsion spring. This is a particularly useful feature in that it permits one to lock the closure/door with the lock arm already in the locked position without having to use the key to unlock and then re-lock the locking cam. This feature would not be possible if the latch wasn't independently rotatable.

Figure 5A:
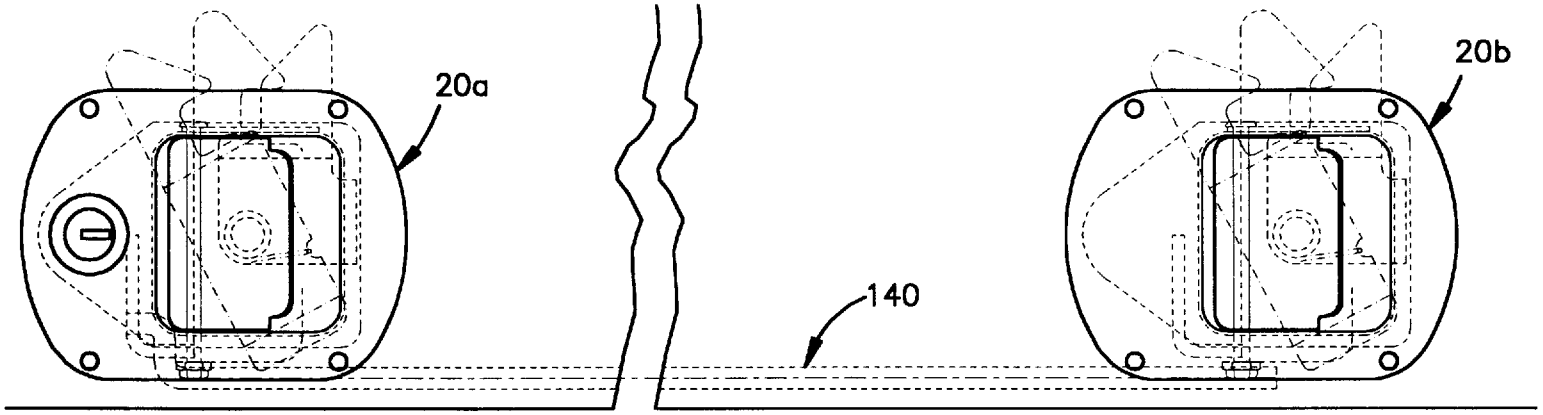
Figure 5B:
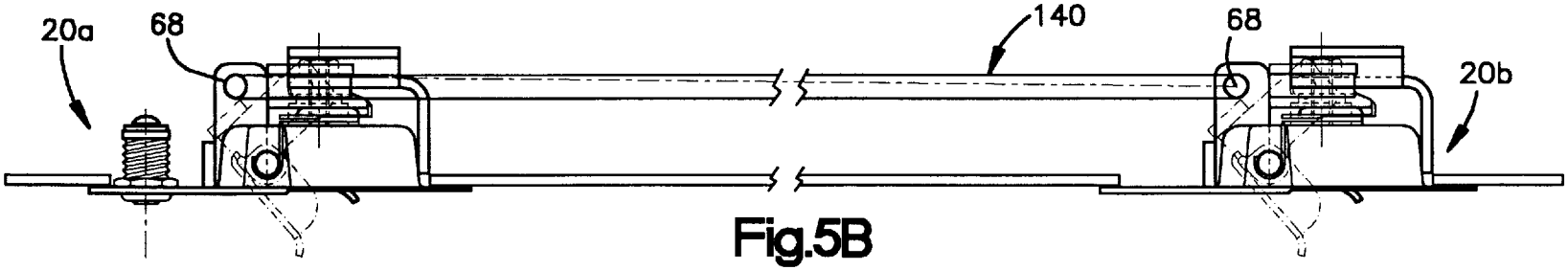

In FIGS. 5A and 5B, a pair of paddle latch assemblies 20*a*, 20*b* are shown interconnected by a cross rod 140. Latch assembly 20*b* represents the non-locking embodiment of the latch assembly with the absence of the locking mechanism. This configuration is particularly useful in applications where a storage receptacle or door has a sufficient width requiring securement of a hinged cover at a number of points. Further it is desirable to have the capability of disengaging or locking each of the paddle latch assemblies remotely from either of the interconnected assemblies, so long as the lockable latch is unlocked. It should be understood that while the present disclosure illustrates an application having only two interconnected assemblies, this disclosure envisions other embodiments having any number of interconnected assemblies.

Each of the latch assemblies 20*a*, 20*b* preferably conforms to that described above, with the exception that one of the latch assemblies arbitrarily 20*b* does not need a key lock. The cross rod 140 has curved ends 142, 144 which are received by the circular holes 68 extending through the trip arms 62 of the trip/lock members 60 in each mechanism. Actuation of either of the latch mechanisms 20*a*, 20*b* through rotation of the paddle handle on either of the mechanisms effects disengagement of the hooked ends of the latch from the corresponding striker elements (not shown) on the door/closure (not shown). In a manner analogous to that described above, as the paddle handle of one of the mechanisms 20*a*, 20*b* rotates the paddle pin, a corresponding rotation of the trip/lock member occurs about the paddle pin. The trip arm engages the latch 100 and induces rotation about the shank such that the latch moves away from the guide. Because the trip arms of each of the mechanisms 20*a*, 20*b* are linked by a crossrod 140, rotation of the trip arm at latch mechanism 20*a* forces rotation of trip arm at latch mechanism 20*b*.

It is also possible with this construction to prevent both of the mechanisms 20*a*, 20*b* from being disengaged by locking only one mechanism, 20*a*. When the locking cam of mechanism 20*a* is rotated into engagement with the locking arm of the trip/lock member, the locking arm is prevented from rotating and thereby preventing disengagement of the hooked end of the latch from the striker. Thus because the locking arm of mechanism 20*a* is fixed, and the locking arms are dependently linked by cross-rod, the locking arm of mechanism 20*b* is similarly prevented from rotating. By unlocking mechanism 20*a*, the locking arms of each of the latch assemblies are free to rotate.

Although the invention has been disclosed and described with respect to certain preferred embodiments, certain variations and modifications may occur to those skilled in the art upon reading this specification. Any such variations and modifications are within the purview of the invention notwithstanding the defining limitations of the accompanying claims and equivalents thereof.

What is claimed is:

1. A paddle operated latch assembly comprising:

a pan having a peripheral mounting flange and a draw with a continuous unperforated major expanse;

a paddle handle mounted within the draw over the major expanse upon a paddle pin which traverses the draw and intersects opposing walls of the draw;

a trip/lock member connected to the pin on an interior side of the pan, the trip/lock member having a trip arm which extends beyond the draw on the interior side of the pan;

a latch rotationally mounted on a shank which extends from the interior side of the pan draw, about which the latch rotates in a plane substantially parallel to the major expanse of the draw, a portion of the latch contacting the trip/lock member when the latch is in the latched position, and a spring which biases the latch into the latched position.

2. The latch assembly of claim 1 wherein the latch comprises a latch hook at an end of the latch generally opposite a point of contact with the trip/lock member.

3. The latch assembly of claim 1 wherein said latch has an open/release position; the trip/lock member further comprises a locking arm of sufficient length such that the locking arm stops rotation of said latch when the latch is rotated to the open/release position.

4. The latch assembly of claim 3 wherein the locking arm of the trip/lock member is generally perpendicular to the trip arm.

5. The latch assembly of claim 1 further comprising a latch guide attached to the rotational mount of the latch, the latch guide having a cut-out configured to form a striker-receiving cavity in conjunction with the latch hook when the latch is in the latched position.

6. The latch assembly of claim 5 wherein the latch guide further comprises a latch guide indexing arm oriented substantially parallel to and flush against a side wall of the pan draw.

7. The latch assembly of claim 1 wherein the spring is a torsion spring disposed about the rotational mount of the latch, with one end connected to the latch and an opposite arm connected to the pin.

8. The latch assembly of claim 1 farther comprising a shoulder spacer disposed about the shank and between the interior side of the pan draw and the latch.

9. The latch assembly of claim 8 wherein the spring is disposed about the shoulder spacer.

10. The latch assembly of claim 1 in combination with another latch assembly, the two latch assemblies connected by a cross-rod between the trip/lock members.

11. A paddle operated latch assembly comprising:

a pan having a peripheral mounting flange and a draw with a continuous unperforated major expanse;

a paddle handle mounted within the draw over the major expanse upon a paddle pin which traverses the draw and intersects opposing walls of the draw;

a trip/lock member connected to the pin on an interior side of the pan, the trip/lock member having a trip arm which extends beyond the draw on the interior side of the pan;

a latch rotationally mounted on a shank which extends from the interior side of the pan draw, about which the latch rotates in a plane substantially parallel to the major expanse of the draw, a portion of the latch contacting the trip/lock member when the latch is in the latched position;

a spring which biases the latch into the latched position, and a lock cylinder mounted in the pan, operative to rotate a locking cam on the interior side of the pan over a locking arm of the trip/lock member when the latch is in the latched position.

12. The latch assembly of claim 11 wherein the latch comprises a latch hook at an end of the latch generally opposite a point of contact with the trip/lock member.

13. The latch assembly of claim 11 wherein said latch has an open/release position; the trip/lock member further comprises a locking arm of sufficient length such that the locking arm stops rotation of said latch when the latch is rotated to the open/release position.

14. The latch assembly of claim 13 wherein the locking arm of the trip/lock member is generally perpendicular to the trip arm.

15. The latch assembly of claim 11 further comprising a latch guide attached to the rotational mount of the latch, the latch guide having a cut-out configured to form a striker-receiving cavity in conjunction with the latch hook when the latch is in the latched position.

16. The latch assembly of claim 15 wherein the latch guide further comprises a latch guide indexing arm oriented substantially parallel to and flush against a side wall of the pan draw.

17. The latch assembly of claim 11 wherein the spring is a torsion spring disposed about the rotational mount of the latch, with one end connected to the latch and an opposite arm connected to the pin.

18. The latch assembly of claim 11 further comprising a shoulder spacer disposed about the shank and between the interior side of the pan draw and the latch.

19. The latch assembly of claim 18 wherein the spring is disposed about the shoulder spacer.

20. The latch assembly of claim 11 in combination with another latch assembly, the two latch assemblies connected by a cross-rod between the trip/lock members.

21. A paddle latch assembly comprising:

a mounting pan having a peripheral flange, a recessed draw and an exterior surface and an interior surface;

said recessed draw having side walls, side wall holes, and a continuous unperforated major expanse;

a paddle handle having a recessed position and an actuated position;

said paddle handle pivotally mounted upon a paddle pin within the recessed draw on said exterior surface;

said paddle pin traversing said draw on the exterior side and extending through said side wall holes;

a latch having a hooked end for securing a striker into a striker receiving cavity;

means for rotatably mounting said latch upon the recessed draw on the interior side of the mounting pan;

said latch having a latched position and a release position;

and cooperating means connected to the paddle handle and positioned for contact with the latch upon rotation of the paddle handle to move the latch from a latched position to a release position.

22. A latch assembly as in claim 21 wherein the latch assembly further comprises a spring connected to said latch and said interior surface of the mounting pan for biasing said latch into the latched position.

23. A latch assembly as in claim 22 wherein said spring is a torsional spring.

24. A latch assembly as in claim 21 wherein said latch rotational mount further comprises:

a shank attached stubsantially perpendicular to the interior side of the draw; and said latch is rotationally mounted upon said shank.

25. A latch assembly as in claim 24 wherein said latch rotational mount further comprises a shoulder spacer mounted upon said shank between said draw and said latch.

26. A latch assembly as in claim 21 wherein said cooperating means further comprises:

a trip/lock member mounted upon flats of said paddle pin on said interior surface adjacent the draw whereby said trip/lock member is rotated on the paddle pin about the draw when the paddle handle is actuated.

27. A latch assembly as in claim 21 wherein said latch assembly further comprises a latch guide mounted on said shank over said latch; said latch guide comprising an incline surface for guiding the striker into the striker receiving cavity and an edge adjacent said incline surface; and said edge cooperating with said latch to form said striker receiving cavity.

28. A latch assembly as in claim 21 wherein said latch assembly further comprises:

a locking cam rotationally attached to a lock cylinder mounted in said peripheral flange; said locking cam having a locked position and an unlocked position; and cooperating means connected to the handle and held under the locking cam for preventing rotation of said handle relative to the draw when the locking cam is in the locked position.

* * * * *